United States Patent [19]

Cordery

[11] Patent Number: 4,710,752

[45] Date of Patent: Dec. 1, 1987

[54] APPARATUS AND METHOD FOR DETECTING A MAGNETIC MARKER

[75] Inventor: Robert A. Cordery, Danbury, Conn.

[73] Assignee: Pitney Bowes Inc., Stamford, Conn.

[21] Appl. No.: 894,429

[22] Filed: Aug. 8, 1986

[51] Int. Cl.[4] ..... G08B 13/24

[52] U.S. Cl. ..... 340/551; 340/572

[58] Field of Search ..... 340/551, 572

[56] References Cited

U.S. PATENT DOCUMENTS 3,747,086 7/1973 Peterson ..... 340/572

4,139,844 2/1979 Reeder ..... 340/572

*Primary Examiner*—Glen R. Swann, III

*Attorney, Agent, or Firm*—Peter Vrahotes; Melvin J. Scolnick; David E. Pitchenik

[57] ABSTRACT

This invention relates to an apparatus and method for detecting the presence of a magnetic marker in an interrogation zone. A dual frequency magnetic field is generated causing a magnetic marker to produce amplitude modulated side band signals at harmonics of the higher frequency field. These side band signals are readily distinguishable from amplitude noise.

32 Claims, 11 Drawing Figures

APPARATUS AND METHOD FOR DETECTING A MAGNETIC MARKER

BACKGROUND OF THE INVENTION

In a typical magnetic electronic article surveillance (EAS) system for detecting magnetic markers, a magnetized marker is placed in a interrogation zone in which an oscillating magnetic field is generated at a frequency "f" (kHz). The EAS system includes a generating coil for generating the magnetic field and a receiving coil for detecting signals generated by the markers. As the field passes a critical value of about 0.1 oersteds (Oe), the magnetic dipole moment of the marker switches and emits a signal. This causes a pulse of voltage to be produced in the receiving coil. Half a cycle later the dipole moment switches back causing a second pulse of the opposite polarity to be produced in the receiving coil. Because the marker is designed to give sharp pulses, the generated signal contains high harmonics, i.e., signals at all multiples of the frequency of the field f. An alarm is set off using a threshold of the higher harmonics, e.g., 9f kHz, 10f kHz . . . 25f kHz. The shortcomings of prior systems are that the signal at these high hrmonics is very small and the amplifier also generates signals of the harmonics due to amplifier non-linearity. A relatively expensive and precise amplifier is needed to isolate the signal from coherent amplifier noise.

SUMMARY OF THE INVENTION

It has been found that generating dual frequency, overlapping magnetic fields of two substantially different values results in a greater ability to detect a marker in an interrogation zone. The first magnetic field is generated with a relatively high frequency and relatively large amplitude and the second overlapping magnetic field is generated with a substantially lower frequency and smaller amplitude. The phase of the higher frequency field at which the marker switches, oscillates at the frequency of the lower field, resulting in side bands being induced around the harmonics of the signal generated by the marker. These side bands are distinct from amplifier noise and are easy to detect. Viewed from the time domain rather than the frequency domain, amplitude of the even harmonics are modulated at the frequency of the lower field. Such amplitude modulated signals easily can be detected by inexpensive and accurate AM radio techniques.

BRIEF DESCRIPTION OF THE DRAWING

Throughout the various figures of the drawing, like numbers are used to identify like parts.

DETAILED DESCRIPTION OF THE PREFERRED EMBODIMENT

Figure 1:
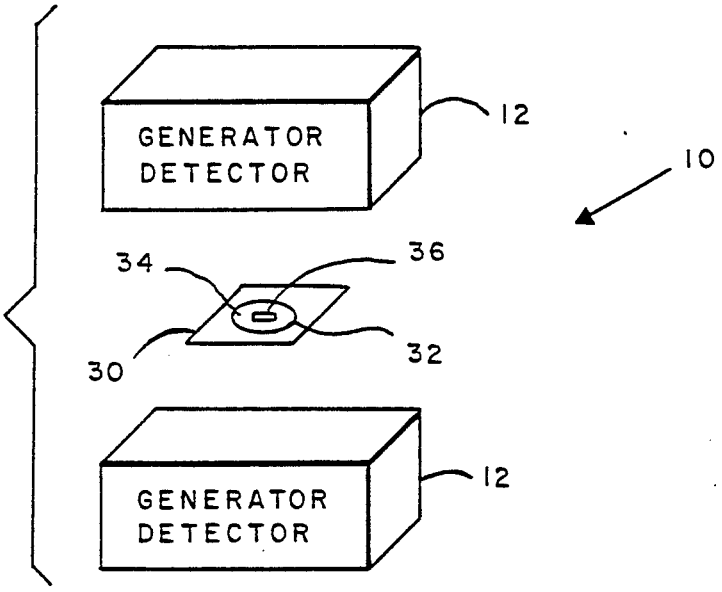
FIG. 1 is a generally block diagram in perspective view showing a system for detecting a magnetic marker.
Figure 2:
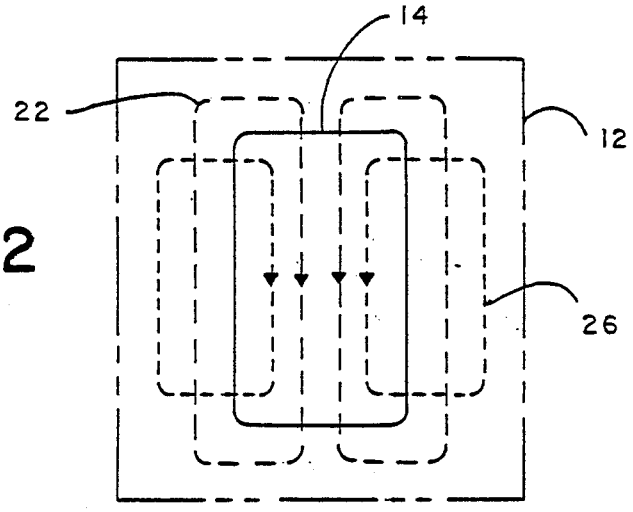
FIG. 2 is a cross sectional view of one of the gates shown in FIG. 1.

Referring initially to FIGS. 1, 2, 5A and 5B, a system is shown generally at 10 wherein a dual frequency magnetic field may be generated to detect the presence of a magnetic marker. This system includes a pair of opposed gates 12 which create an interrogation zone therebetween as will be explained hereinafter. Each of the gates 12 includes a first magnetic field generating circuit 13 that has a coil 14. This coil 14 is connected to a first field generator 16 and will generate a magnetic field of relatively high frequency, in the range of 5–20 kHz, with a relatively high amplitude, 3–18 Oe. Also included in the first magnetic field generating circuit 13 are a plurality of capacitors 18. Located adjacent to and overlapping the first coil 14 are a pair of coils 22 that form part of a second field generating circuit 20. The coils 22 are connected to a second generator 24 with the current flowing in opposed directions as indicated by the arrows. The second field generating circuit 20 will generate a magnetic field of relatively low frequency, i.e., 0.05–3.0 kHz and an amplitude in the range of 0.1 to 0.5 Oe. The ratio of the frequency of the first field to that of the second field can vary from 2:1 to 100:1 with the preferable ratio being approximately 20:1. The ratio of the amplitude of the first field to that of the second field can vary from 2:1 to 30:1, the preferable ratio being about 5:1. Also associated with the interrogation zone is a pair of receiving coils 26 which are connected to a detector 28 (see FIG. 5C). As seen in FIG. 2, the detector coils 26 overlap both the high frequency coil 14 and low frequency coils 22 with the current flow clockwise in one coil 26 and counter-clockwise in the other. The detector 28 may be any of a number of commercially available devices for detecting AM radio signals and may take the form of a buzzer, siren, light and the like.

An article 30, which may be a package, article of clothing or the like, having a marker 32 connected thereto is shown within the interrogation zone. The interrogation zone is defined as the area between the two gates 12. The magnetic marker 32 is made of a solid material 34 that supports a ferromagnetic material 36 capable of inducing a sharp electrical pulse in the pick-up coil 26 in response to the generated magnetic fields. An example of such a ferromagnetic material is permalloy. Normally the ferromagnetic material will be in the form of a strip approximately two to three inches long, having a width of approximately of one-quarter of an inch and a thickness of about 10 mils. This magnetic strip 36 is placed within or into the support material 34. This support material can be paper or plastic which may take the form of a label, ticket or tag. This marker 32 can be attached to or located within any type of article 30 for which surveillance is required.

Figure 3:
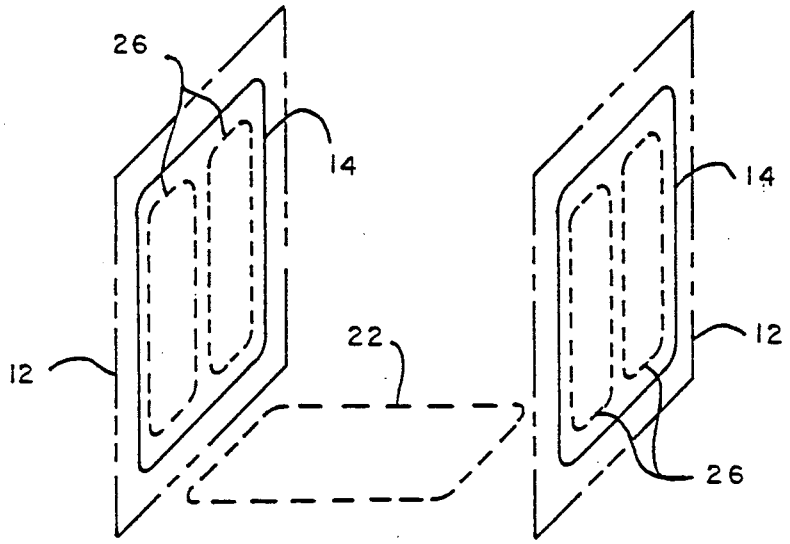
FIG. 3 is an alternative embodiment of the invention shown in FIG. 2.

As shown in FIG. 2, the coils 14, 22, and 26 overlap one another and are contained within a gate 12, there being two gates opposed and parallel to one another. An alternative arrangement is shown in FIG. 3 wherein the high frequency coil 14 and detector coils 26 are supported within opposed gates 12 and the low frequency field is generated by a coil 22 located in the floor at a location between the gates. The field generated by this coil 22 will have the same frequency and amplitude characteristics as the two coils shown in FIG. 2.

Figure 4:
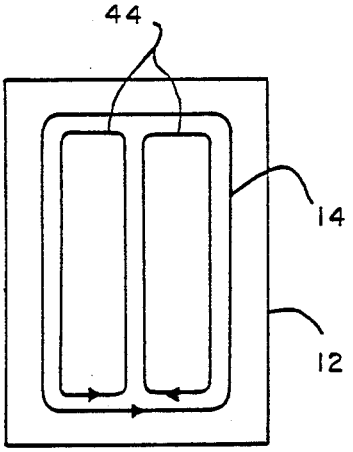
FIG. 4 is another alternative embodiment of the invention shown in FIGS. 2 and 3.
Figure 5A:
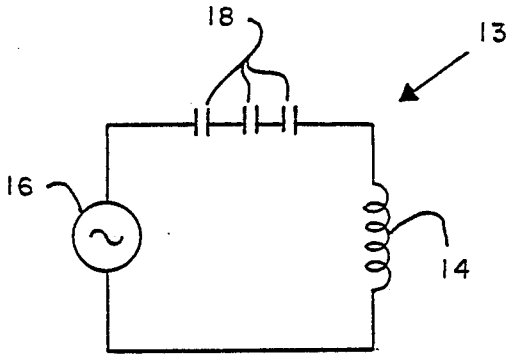
FIG. 5A is a circuit diagram of the high frequency generator of FIGS. 1–4.
Figure 5B:
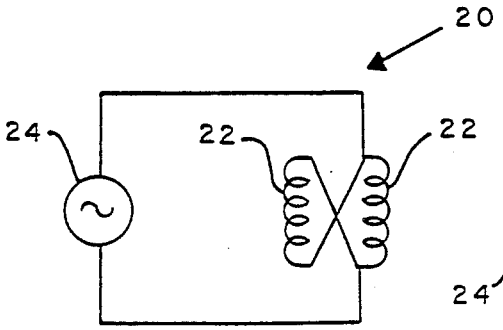
FIG. 5B is a circuit diagram of the low frequency generator of FIGS. 1–3.
Figure 5C:
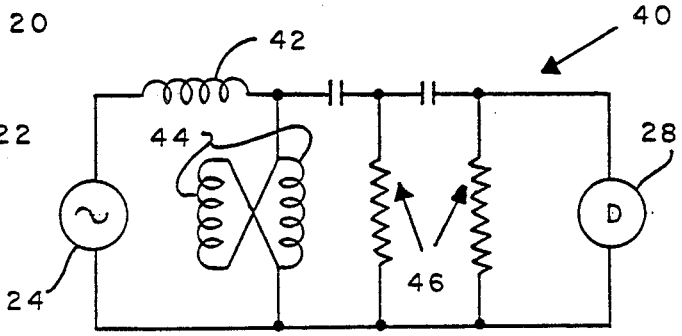
FIG. 5C is a circuit diagram of the combination low frequency generator, detector circuit of FIG. 4.

Still another embodiment of the invention is shown in FIGS. 4 and 5C wherein the low frequency field generation and detection device are contained within one circuit 40. This circuit includes a low frequency generator 24, a choke 42, a pair of coils 44, a pair of RC filters 46 and a detector 28. With this circuit 40, the coils 44 will serve both as a low frequency field and to respond to a signal generated by a marker 32 to activate the detector 28 in cooperation with the RC filters 46.

The field H(t) generated by the generating coils 14, 22 in the interrogation zone is defined by the equation:

$$H(t)=H_d\cos(2\pi f_d t)+H_m\cos(2\pi f_m t)$$

where

Hd=the amplitude of the field generated by the first coil $f_d$=the frequent of the field generated by the first coil $H_m$=the amplitude of the field generated by the second coil 16, and $f_m$=the frequency of the field generated by the second coil 16.

Figure 6A:
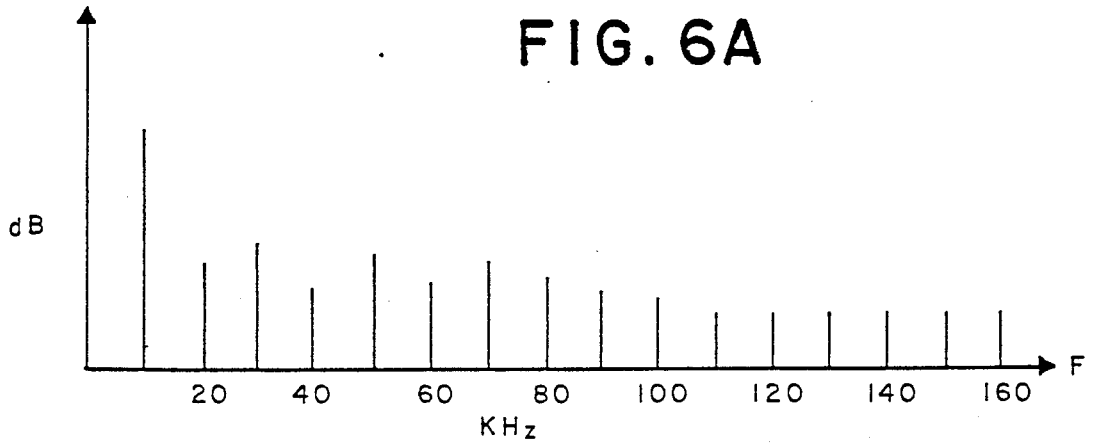
FIGS. 6A–6D are graphs showing generated signals under different modes of operation.

Referring now to FIGS. 6A to 6D, graphs are included showing various modes of operation. FIG. 6A shows signals produced in an interrogation zone with no marker present and a frequency field generated only by the first field generator 13 at a frequency of 10 kHz. The signals represented in the graph at the various frequencies are produced by amplifier noise only.

Figure 6B:
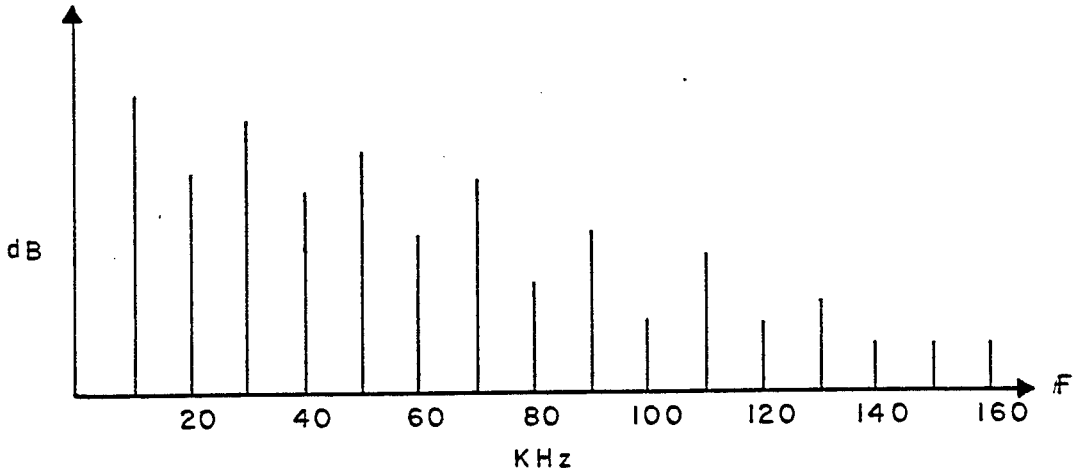

FIG. 6B is a graph similar to FIG. 6A except that it shows the effect of introducing a magnetic marker 32 into the interrogation zone. It will be noted that the signals in the interrogation zone are stronger but the signal from the marker 32 is generally indistinguishable from amplifier noise.

Figure 6C:
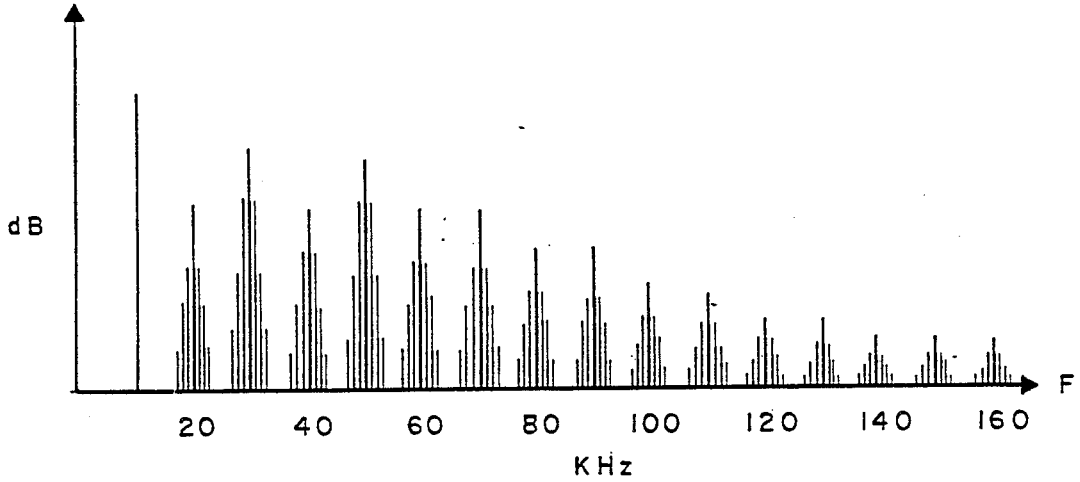

FIG. 6C demonstrates the effect of creating a dual frequency field by enabling both the first field generator 13 and the second field generator 20 and with a marker 32 in the interrogation zone. In this example, the second field generator 20 creates a magnetic field of one kHz and an amplitude of 0.2 Oe which is added to the field created by the first field generator 13, i.e. 10 kHz and 5 Oe. It will be noted that side bands are created about any harmonic of the frequency of the field generated by the first generator 16 that are readily detectable by an AM demodulator or receiver 28. These side bands are readily detectable because they are distinct from the field noise since modulation is not present in amplifier noise. As is known, harmonics are integer multiples of the frequency of the field.

Figure 6D:
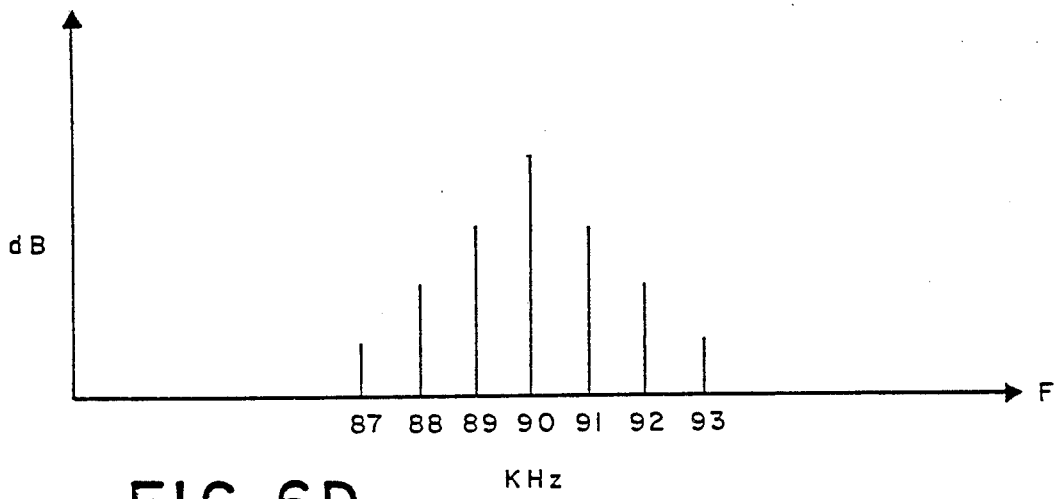

FIG. 6D is a graph showing an expansion of the ninth harmonic. The 90 kHz signal includes both the ninth harmonic and amplifier noise. The side bands, i.e., 87–89 kHz and 91–93 kHz contain no amplifier noise and, as a consequence, the presence of these side bands evidences the existence of a marker 32 in the interrogation zone.

The advantages of this detection system are as follows:

(1) the amplifier harmonics do not interfere with signal detection so that a low cost amplifier can be used;

(2) the signal is an amplitude modulated sign wave at each harmonic of the high frequency field "f", i.e., 2f kHz, 3f kHz, 25f kHz, and (3) the signature of the marker signal is clearly distinguished from coherent noise sources so fewer false alarms will result.

What is claimed is:

1. A system for detecting the presence of a ferromagnetic marker in an interrogation zone, comprising:
   first generating means for generating a first magnetic field in the interrogation zone at a first frequency,
   second generating means for generating a second magnetic field in the interrogation zone at a second frequency,
   said second frequency having a value less than approximately one-fifth of said first frequency and
   means for detecting amplitude modulated signals produced by a magnetic marker present in the interrogation zone when said first and second magnetic field generating means are enabled.

2. The system of claim 1 wherein said first frequency is greater than 5 kHz and said second frequency is less than 2 kHz.

3. The system of claim 1 wherein the ratio of the frequency of said first magnetic field to said second magnetic field varies from 5:1 to 100:1.

4. The system of claim 1 wherein the ratio of the frequency of the first magnetic field to the second magnetic field is approximately 20:1.

5. A system for detecting the presence of a ferromagnetic marker in an interrogation zone, comprising:
   first generating means for generating a magnetic field in the interrogation zone at a first frequency and first amplitude,
   second generating means for generating a second magnetic field in the interrogation zone at a second frequency and a second amplitude,
   said second frequency having a value of less than one fifth of said first frequency, and
   means for detecting amplitude modulated signals produced by a magnetic marker present in the interrogation zone.

6. The system of claim 5 wherein the ratio of the amplitude of said first magnetic field to the amplitude of the second magnetic field varies from 2:1 to 30:1.

7. The system of claim 5 where the ratio of the amplitude of said first magnetic field to the amplitude of the second magnetic field is approximately 5:1.

8. The system of claim 5 wherein the ratio of the frequency of the first magnetic field to the frequency of the second magnetic field varies from 5:1 to 100:1.

9. The system of claim 5 wherein the ratio of the frequency of the first magnetic field to the frequency of the second magnetic field is 20:1.

10. The system of claim 6 wherein said first frequency is greater than 5 kHz, said first amplitude is greater than 3 Oe, said second frequency is less than 2 kHz and said second amplitude is less than 0.5 Oe.

11. A system for detecting the presence of a ferromagnetic marker in an interrogation zone, comprising:
   first generating means for generating a first magnetic field in the interrogation zone at a first frequency,
   second generating means for generating a second magnetic field in the interrogation zone at a second frequency,
   said second frequency having a value less than approximately one-fifth of said first frequency and
   means for measuring amplitude variations of a predetermined harmonic frequency of said first magnetic field produced by a magnetic marker present in the interrogation zone when said first and second magnetic field generating means are enabled.

12. The system of claim 11 wherein said first frequency is greater than 5 kHz and said second frequency is less than 2 kHz.

13. The system of claim 11 wherein the ratio of the frequency of the first magnetic field to the frequency of trhe second magnetic field varies from 2:1 to 100:1.

14. The system of claim 11 wherein the ratio of the frequency of the first magnetic field to the frequency of the second magnetic field is 20:1.

15. A system for detecting the presence of a ferromagnetic marker in an interrogation zone, comprising:

first generating means for generating a magnetic field in the interrogation zone at a first frequency and first amplitude, second generating means for generating a second magnetic field in the interrogation zone at a second frequency and a second amplitude, said second frequency having a value less than one-fifth of said first frequency and said second amplitude having a value of less than one-fourth of said first amplitude, and means for detecting amplitude variations about a predetermined multiple of said first magnetic field produced by a magnetic marker present in the interrogation zone when said first and second magnetic field generating means are enabled.

16. The system of claim 15 wherein said first frequency is greater than 5 kHz, said first amplitude is greater than 3 Oe, said second frequency is less than 2 kHz and said second amplitude is less than 0.5 Oe.

17. The system of claim 15 wherein the ratios of the amplitude of said first magnetic field to the amplitude of the second magnetic field varies from 2:1 to 30:1.

18. The system of claim 15 wherein the ratio of the amplitude of said first magnetic field to the amplitude of the second magnetic field is approximately 5:1.

19. The system of claim 15 wherein the ratio of the frequency of the first magnetic field to the frequency of the second magnetic field varies from 5:1 to 100:1.

20. The system of claim 15 wherein the ratio of the frequency of the first magnetic field to the frequency of second magnetic field is 20:1.

21. A method of detecting a magnetic marker in an interrogation zone, the steps comprising:

(a) generating a first magnetic field in the interrogation zone at a first frequency, (b) generating a second magnetic field in the interrogation zone at a second frequency having a lower value than said first frequency, and (c) detecting the presence of a magnetic marker in the interrogation zone by detecting side band signals generated by the magnetic marker as a result of being exposed to the first and second magnetic fields simultaneously.

22. The method of claim 21 including the step of generating a magnetic field with a first frequency of greater than 5 kHz and generating a second magnetic field with a frequency of less than 2 kHz.

23. The method of claim 21 wherein the step of generating the first and second magnetic fields includes generating said first and second fields in a manner such that the ratio of the frequency of the first magnetic field to the frequency of the second magnetic field varies from 2:1 to 100:1.

24. The method of claim 21 wherein the step of generating the first and second magnetic fields includes generating said first and second fields in a manner such that the ratio of the frequency of the first magnetic field to the frequency of the second magnetic field is 20:1.

25. A method of detecting a magnetic marker in an interrogation zone, the steps comprising:

(a) generating a first magnetic field in the interrogation zone at a first frequency and first amplitude, (b) generating a second magnetic field in the interrogation zone at a second frequency having a lower value than the first frequency and a second amplitude having a lower value than the first amplitude, and (c) detecting the presence of a magnetic marker in the interrogation zone by detecting side band signals about a predetermined multiple of the frequency of the first magnetic field generated by the magnetic marker as a result of being exposed to the first and second magnetic field simultaneously.

26. The method of claim 25 wherein the step of generating the first and second magnetic fields includes generating the first field with a frequency greater than 5 kHz and an amplitude greater than 3 Oe, and generating the second magnetic field with a frequency of less than 2 kHz and an amplitude of less than 0.5 Oe.

27. The method of claim 25 wherein generating the first and second magnetic fields yields a ratio of the amplitude of said first magnetic field to the amplitude of the second magnetic field that varies from 2:1 to 30:1.

28. The method of claim 27 wherein generating the first and second magnetic fields yields a ratio of the amplitude of the first magnetic field to the amplitude of the second magnetic field of approximately 5:1.

29. The method of claim 25 wherein generating the first and second magnetic fields yields a ratio of the frequency of the first magnetic field to the frequency of the second magnetic field which varies from 5:1 to 100:1.

30. The method of claim 25 wherein generating the first and second magnetic fields yields a ratio of the frequency of the first magnetic field to the frequency of the second magnetic field of approximately 20:1.

31. A method of detecting the presence of a magnetic marker in an interrogation zone, the steps comprising:

(a) generating a dual frequency magnetic field of frequencies $f_1$ and $f_2$ in the interrogation zone, wherein $f_1$ is at least twice the value of $f_2$, (b) passing a magnetic marker through the interrogation zone to generate sideband signals around the harmonics of the frequency $f_1$ and (c) determining the presence of the magnetic marker in the interrogation zone by detecting the sideband signals.

32. A system for detecting the presence of a ferromagnetic marker in an interrogation zone, comprising:

(a) means for generating a magnetic field of frequencies $f_1$ and $f_2$ in the interrogation zone, wherein $f_1$ is at least twice the value of $f_2$, whereby sideband signals around the harmonics of the $f_1$ frequency are generated upon a magnetic marker's being passed through the interrogation zone and (b) means for determining the presence of a marker in the interrogation zone by detecting said sideband signals.

* * * * *